US009285148B2

(12) United States Patent
Kasagi et al.

(10) Patent No.: US 9,285,148 B2
(45) Date of Patent: Mar. 15, 2016

(54) AIR CONDITIONER USING OIL RETURN OPERATION BASED ON OUTDOOR AIR TEMPERATURE

(75) Inventors: Tsukasa Kasagi, Tokyo (JP); Seiji Hiramatsu, Tokyo (JP); Tetsuo Tsuji, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 1018 days.

(21) Appl. No.: 13/499,834

(22) PCT Filed: Jan. 7, 2011

(86) PCT No.: PCT/JP2011/050214

§ 371 (c)(1),
(2), (4) Date: Apr. 2, 2012

(87) PCT Pub. No.: WO2011/089938

PCT Pub. Date: Jul. 28, 2011

(65) Prior Publication Data

US 2012/0192581 A1 Aug. 2, 2012

(30) Foreign Application Priority Data

Jan. 25, 2010 (JP) ..... 2010-013050

(51) Int. Cl.
*F25B 31/00* (2006.01)
*F25B 43/02* (2006.01)

(52) U.S. Cl.
CPC ..... *F25B 43/02* (2013.01); *F25B 31/004* (2013.01); *F25B 2500/16* (2013.01); *F25B 2700/2106* (2013.01)

(58) Field of Classification Search
CPC ..... F25B 31/004; F25B 43/02; F25B 2700/2106; F25B 2500/16; F25B 31/002; F25B 2500/15; F25B 2700/03; F25B 2700/21155
USPC ..... 62/192, 84, 193
See application file for complete search history.

(56) References Cited

U.S. PATENT DOCUMENTS 5,551,249 A * 9/1996 Van Steenburgh, Jr. ..... 62/196.4
2003/0205052 A1* 11/2003 Kim ..... F25B 1/10 62/228.1

(Continued)

FOREIGN PATENT DOCUMENTS

JP 07-072654 B2 8/1995
JP 09-170828 A 6/1997

(Continued)

OTHER PUBLICATIONS

International Search Report of PCT/JP2011/050214, dated Mar. 15, 2011.

(Continued)

*Primary Examiner* — Mohammad M Ali
*Assistant Examiner* — Daniel C Comings
(74) *Attorney, Agent, or Firm* — Westerman, Hattori, Daniels & Adrian, LLP

(57) ABSTRACT

In an air conditioner provided with an oil-return-operation control portion that performs an oil-return operation, when oil-return conditions are satisfied, by controlling the rotational speed of a compressor, the degree of opening of an expansion valve, etc., with a predetermined refrigerant cycle and provided with high-outdoor-air-temperature oil-return operation means for performing a forced oil-return operation via the oil-return-operation control portion when an outdoor temperature increases and a state in which a detection value of an outdoor air temperature sensor is higher than a set value continues for a predetermined period of time, the oil-return operation is prohibited for a certain period of time after performing the forced oil-return operation via the high-outdoor-air-temperature oil-return operation means.

4 Claims, 2 Drawing Sheets

(56) References Cited

U.S. PATENT DOCUMENTS

| | | | | |
|---|---|---|---|---|
| 2004/0159111 | A1 | 8/2004 | Takegami et al. | |
| 2005/0284156 | A1 | 12/2005 | Scarcella et al. | |
| 2006/0080990 | A1 | 4/2006 | Lee et al. | |
| 2010/0175396 | A1 | 7/2010 | Lifson et al. | |
| 2011/0005251 | A1* | 1/2011 | Beekman et al. | 62/228.3 |

FOREIGN PATENT DOCUMENTS

| | | | |
|---|---|---|---|
| JP | 9-318166 | A | 12/1997 |
| JP | 2002-243289 | A | 8/2002 |
| JP | 2005-351598 | A | 12/2005 |
| JP | 2007-057126 | A | 3/2007 |
| JP | 2007-139276 | A | 6/2007 |
| JP | 2009-257759 | A | 11/2009 |
| KR | 1997-0047377 | A | 7/1997 |
| KR | 10-2010-0096858 | A | 9/2010 |
| WO | 03/085332 | A1 | 10/2003 |
| WO | 2008/024110 | A1 | 2/2008 |

OTHER PUBLICATIONS

Japanese Decision to Grant a Patent dated Jan. 21, 2014, issued in Japanese Patent Application No. 2010-013050, w/English translation.

Extended European Search Report (EESR) dated Dec. 6, 2013, in corresponding to European Application No. 11734545.4.

Korean Notice of Allowance dated Jun. 1, 2013, issued in corresponding Korean Patent Application No. 10-2012-7009251, w/English translation.

Chinese Notice of Allowance dated Feb. 9, 2015, issued in corresponding CN Patent Application No. 201180004250.7 (2 pages). Explanation of relevance—"The Notice of Allowance has been received."

* cited by examiner

AIR CONDITIONER USING OIL RETURN OPERATION BASED ON OUTDOOR AIR TEMPERATURE

TECHNICAL FIELD

The present invention relates to an air conditioner provided with an oil-return-operation control portion that performs an oil-return operation in which lubricant that has flowed out to a refrigerant-circuit side is recovered to ensure a predetermined amount of the lubricant inside a compressor.

BACKGROUND ART

In a multi-type air conditioner employed in air conditioning of a building, etc., the length of refrigerant pipes that connect a plurality of indoor units and outdoor units becomes long. Because of this, during the operation of the air conditioner, lubricant that has flowed out together with refrigerant from a compressor to a refrigerant circuit side tends to remain at the refrigerant circuit side, and a situation tends to occur in which the amount of lubricant at the compressor side becomes insufficient. Therefore, in such an air conditioner, in order to recover the lubricant that has flowed out from the compressor to the refrigerant circuit side back into the compressor, an oil-return operation is performed at predetermined timing by counting up the cumulative operating time of the air conditioner or by calculating the amount of lubricant that has flowed out from the compressor and by detecting that the amount has reached a predetermined amount (for example, see Patent Literatures 1 and 2).

This oil-return operation is generally performed by setting a refrigerating cycle to a cooling cycle, by setting a cooling expansion valve on an indoor unit side to open, and by increasing the circulated amount and flow speed of refrigerant by increasing the rotational speed of the compressor. By doing so, lubricant remaining in the refrigerant circuit, such as a heat exchanger, refrigerant pipes, etc. is recovered back into the compressor along with the refrigerant.

On the other hand, when an operation which is under high pressure to begin with is switched to the oil-return operation, the high pressure sometimes abruptly increases because the amount of circulated refrigerant increases due to an increase in the rotational speed of the compressor. When the high pressure undergoes a transient abnormal increase, a high-pressure pressure sensor for protection against high pressure is activated, and the compressor may come to an abnormal halt due to high-pressure shutdown. Therefore, Patent Literature 3 discloses a technique in which, when conditions for oil recovery are met, an abnormal increase in the high pressure is suppressed in accordance with the operating conditions at that time by decreasing the amount of refrigerant circulated by bypassing discharged gas or by increasing the condensation capacity with an outdoor fan.

CITATION LIST

Patent Literature

{PTL 1} Japanese Unexamined Patent Application, Publication No. 2009-257759.

{PTL 2} Japanese Unexamined Patent Application, Publication No. 2005-351598.

{PTL 3} Japanese Examined Patent Application, Publication No. Hei 7-72654 (Publication of Japanese Patent No. 2035389).

SUMMARY OF INVENTION

Technical Problem

However, in a case in which an air conditioner is used in a region where the outdoor air temperature becomes extremely high or in a case in which the surrounding temperature abnormally increases because outdoor units are installed in locations where heat tends to accumulate, when the rotational speed of a compressor increases by switching to the oil-return operation, the pressure of the refrigerant also increases to the extent that it exceeds a set value for the high-pressure pressure switch, and therefore, the oil-return operation sometimes fails to be commenced. Because of this, there is a problem in that the operation sometimes continues for a long time without recovering the lubricant, which decreases the amount of lubricant in the compressor, and the compressor may fail when the lubricant runs out. Patent Literatures 1 to 3 do not provide inventions that can eliminate such a failure in commencing the oil-return operation over a long period of time due to a high outdoor air temperature.

The present invention has been conceived in light of such circumstances, and an object thereof is to provide an air conditioner that is capable of preventing a failure to commence an oil-return operation over a long period of time due to abnormally high outdoor air temperature and that is capable of preventing damage caused by a compressor running out of lubricant.

Solution to Problem

In order to solve the above problems, an air conditioner of the present invention employs the following solutions.

Specifically, the air conditioner according to the present invention is an air conditioner which is provided with an oil-return-operation control portion that performs an oil-return operation, when oil-return conditions are satisfied, by controlling a compressor rotational speed, a degree of opening of an expansion valve, etc., with a predetermined refrigerant cycle, the air conditioner including high-outdoor-air-temperature oil-return operation means for performing a forced oil-return operation via the oil-return-operation control portion when an outdoor temperature increases and a state in which a detection value from an outdoor air temperature sensor is higher than a set value continues for a predetermined period of time, wherein the oil-return operation is prohibited for a certain period of time after performing the forced oil-return operation via the high-outdoor-air-temperature oil-return operation means.

With the present invention, in the air conditioner including the oil-return-operation control portion that performs the oil-return operation when the oil-return-operation conditions are satisfied and the high-outdoor-air-temperature oil-return operation means for performing the forced oil-return operation via the oil-return-operation control portion when the outdoor temperature increases and the state in which the detection value of the outdoor air temperature sensor is higher than the set value continues for the predetermined period of time, the oil-return operation is prohibited for the certain period of time after performing the forced oil-return operation via the high-outdoor-air-temperature oil-return operation means; therefore, when the state in which the outdoor air temperature is higher than the set value has continued for the predetermined time, the forced oil-return operation can be performed in advance before the temperature increases further, which makes it impossible (difficult) establish the oil-return operation is no due to the high-pressure shutdown, and, by doing so, in the certain period of time that follows, the operation of the air conditioner can be continued without having to perform the oil-return operation. Therefore, it is possible to reliably avoid a situation in which the operation is continued for a long period of time without commencing the oil-return operation due to an abnormally high temperature and in which the amount of the lubricant in the compressor decreases such that the lubricant in the compressor runs out, causing damage, and thus, the reliability of the air conditioner can be increased.

With regard to the air conditioner according to the present invention, it is preferable that, in the above-described air conditioner, the forced oil-return operation due to re-detection of the outdoor air temperature at or above the set value and the oil-return operation due to detection of oil-return conditions be prohibited during the certain period of time in which the oil-return operation is prohibited.

With this configuration, the forced oil-return operation due to re-detection of the outdoor air temperature at or above the set value and the oil-return operation due to detection of the oil-return conditions are prohibited during the certain period of time in which the oil-return operation is prohibited; therefore, by prohibiting the forced oil-return operation due to re-detection of the outdoor air temperature at or above the set value and the oil-return operation due to detection of the oil-return conditions for the certain period of time after performing the forced oil-return operation via the high-outdoor-temperature oil-return operation means, it is possible to prevent unnecessarily repeating the oil-return operation. Therefore, interruption of air conditioning operation caused by performing the oil-return operation can be minimized, and the comfort level can be maintained.

In addition, in the air conditioner of the present invention, it is preferable that, in any of the above-described air conditioners, the prohibition of the oil-return operation for the certain period of time be removed when the outdoor air temperature is below the set value.

With this configuration, the prohibition of the oil-return operation for the certain period of time is removed when the outdoor air temperature is below the set value; therefore, when the prohibition of the oil-return operation for the certain period of time is removed because the outdoor air temperature is below the set value, the normal oil-return operation is restored, and thus, the oil-return operation is performed when the predetermined oil-return conditions are satisfied. Therefore, it is possible to cope with an environment in which the outdoor air temperature is high while maintaining conventional oil-return-operation function, and the regions for installing the air conditioner can be expanded.

Furthermore, in the air conditioner of the present invention, it is preferable that, in any of the above-described air conditioners, high-pressure-protection-value changing means for increasing a high-pressure-protection value associated with an increase in refrigerant pressure by a predetermined value be provided, at least when performing the forced oil-returning operation via the high-outdoor-air-temperature oil-return operation means.

This configuration is provided with the high-pressure-protection-value changing means by which the high-pressure-protection value associated with the increase in the refrigerant pressure is increased by the predetermined value, at least when performing the forced oil-returning operation via the high-outdoor-air-temperature oil-return operation means; therefore, when the oil-return operation is performed by increasing the compressor rotational speed in an environment in which the outdoor air temperature is high, although the high pressure easily increases, the high-pressure pressure switch is activated, and thus the compressor may come to an abnormal halt due high-pressure shutdown, the abnormal stop of the compressor due to the high-pressure shutdown can be prevented by increasing the high pressure-protection value by the predetermined value via the high-pressure-protection-value changing means, and the forced oil-return operation can be performed. Therefore, the oil-return operation can be performed reliably even if installed in an environment in which the outdoor air temperature is high, and the reliability of the air conditioner can be increased by avoiding a situation in which the lubricant in the compressor runs out. Note that the changing of the high-pressure-protection value may similarly be performed by the high-pressure-protection-value changing means during the normal oil-return operation when the oil-return conditions are satisfied, in addition to when performing the forced oil-return operation via the high-outdoor-air-temperature oil-return operation means.

Advantageous Effects of Invention

With the present invention, when the state in which the outdoor air temperature is higher than the set value has continued for the predetermined time, the forced oil-return operation can be performed in advance via the high-outdoor-air-temperature oil-return operation means before the temperature increases further and the oil-return operation is not commenced due to high-pressure shutdown, and, by doing so, in the certain period of time that follows, the operation of the air conditioner can be continued without having to perform the oil-return operation; therefore, it is possible to reliably avoid a situation in which the operation is continued for a long period of time without commencing the oil-return operation due to an abnormally high temperature and in which the amount of lubricant in the compressor decreases such that the lubricant in the compressor runs out, causing damage, and thus, the reliability of the air conditioner can be increased.

DESCRIPTION OF EMBODIMENT

An embodiment of the present invention will be described below with reference to FIGS. 1 and 2.

Figure 1:
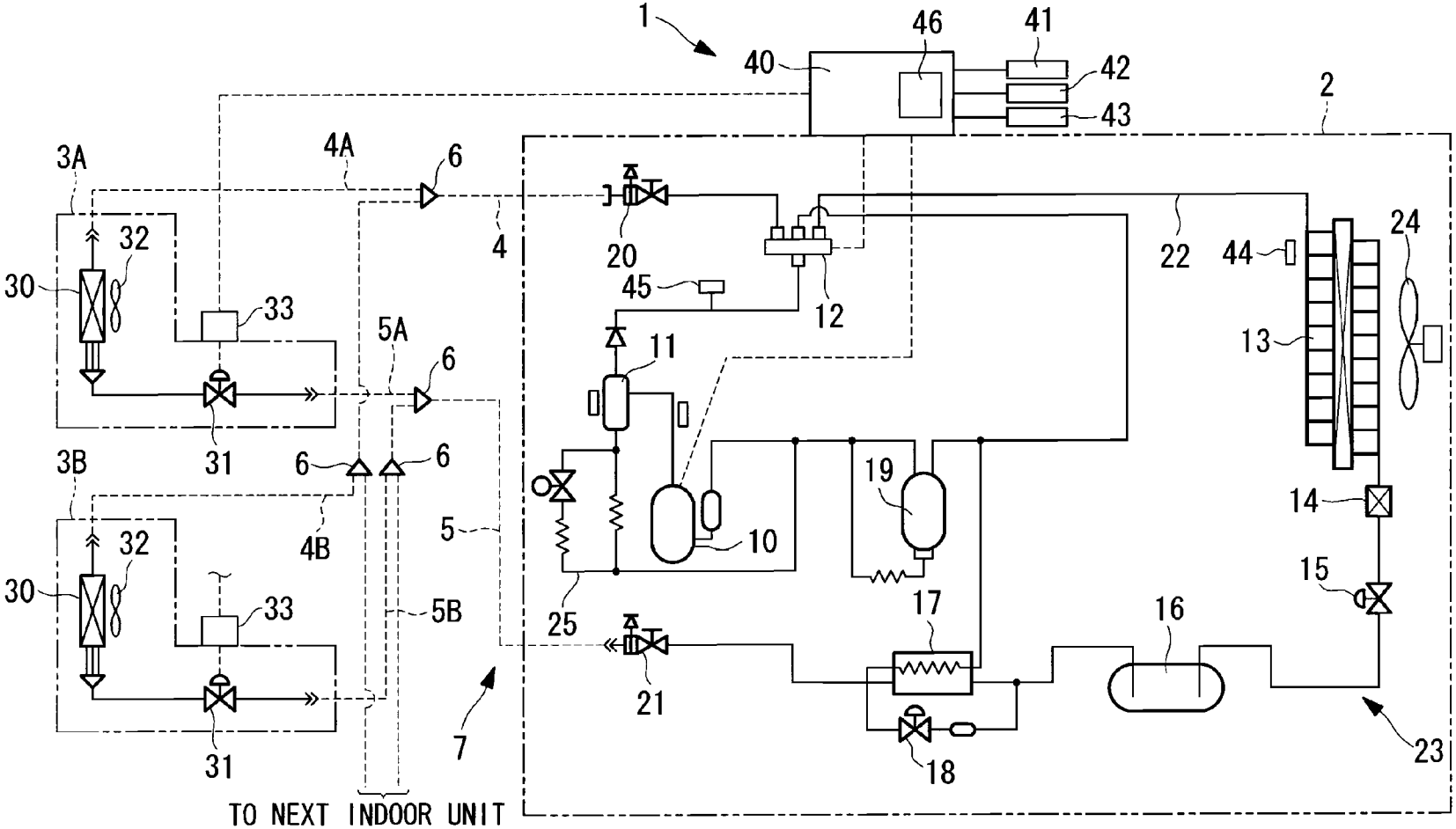
FIG. 1 is a refrigerant circuit diagram for an air conditioner according to an embodiment of the present invention.
Figure 2:
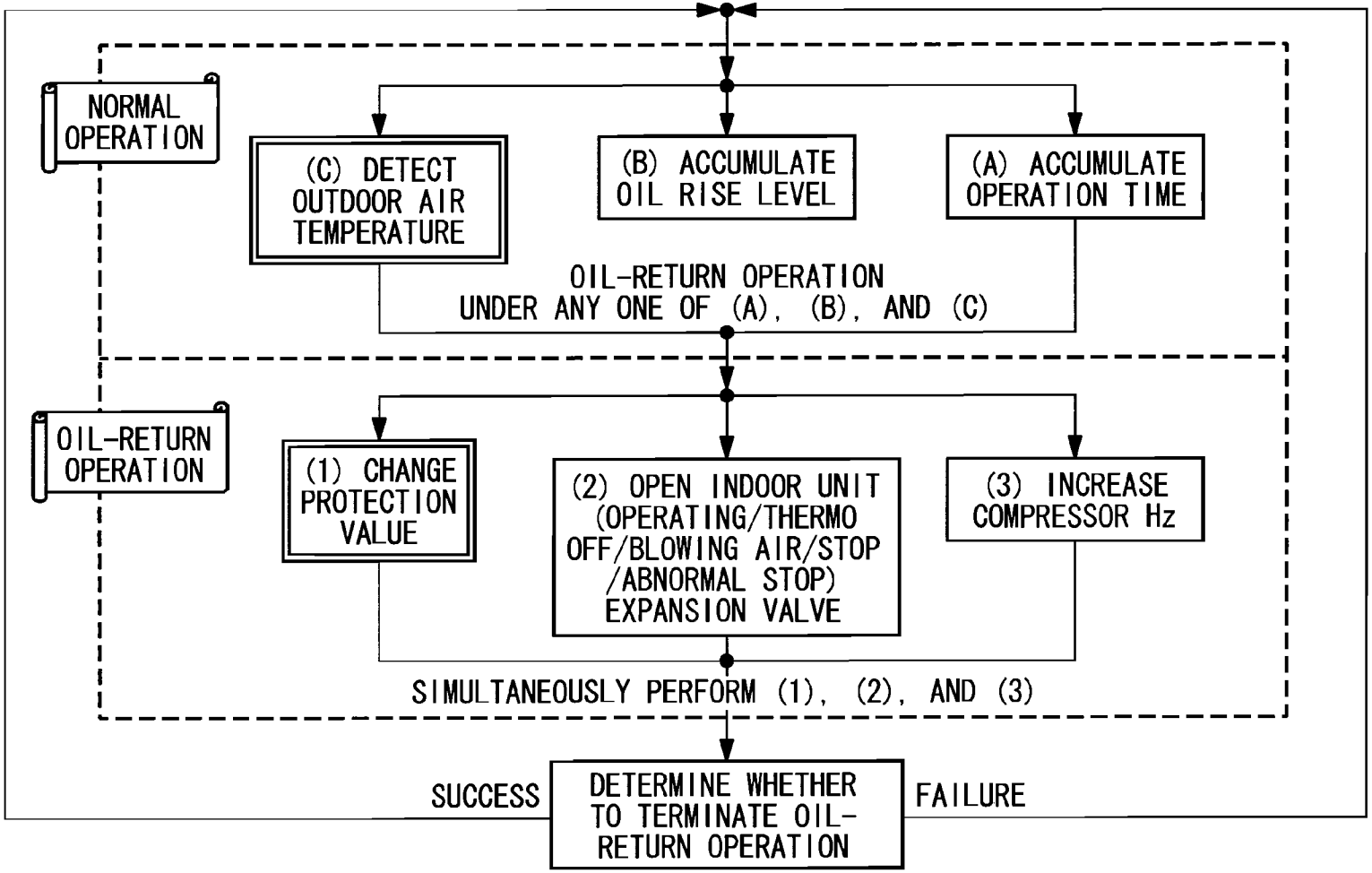
FIG. 2 is a control flow diagram for an oil-return operation of the air conditioner shown in FIG. 1.

FIG. 1 shows a refrigerant circuit diagram of an air conditioner according to the embodiment of the present invention, and FIG. 2 shows a control flow diagram for an oil-return operation thereof. In this embodiment, a multi-type air conditioner 1 in which a plurality of indoor units 3A and 3B are connected in parallel to a single outdoor unit 2 is described as the air conditioner 1. The plurality of the indoor units 3A and 3B are connected in parallel with each other via splitters 6 between a gas-side pipe 4 and a liquid-side pipe 5 that lead out from the outdoor unit 2.

The outdoor unit 2 is provided with an inverter-driven compressor 10 that compresses refrigerant, an oil separator 11 that separates lubricant from refrigerant gas, a four-way switch valve 12 that switches the circulation direction of the refrigerant, an outdoor heat exchanger 13 that performs heat exchange between the refrigerant and outdoor air, a supercooling coil 14 integrally formed with the outdoor heat exchanger 13, a heating expansion valve (EEVH) 15, a receiver 16 for storing liquid refrigerant, a supercooling heat exchanger 17 that causes supercooling of the liquid refrigerant, a supercooling expansion valve (EEVSC) 18 that controls the amount of refrigerant that is diverted to the supercooling heat exchanger 17, an accumulator 19 that separates a liquid component from refrigerant gas taken into the compressor 10 so that only a gas component is taken into the compressor 10 side, a gas-side actuating valve 20, and a liquid-side actuating valve 21.

The individual equipment described above on the outdoor unit 2 side is connected in a known manner via a refrigerant pipe 22, thus forming an outdoor-side refrigerant circuit 23. In addition, the outdoor unit 2 is provided with an outdoor fan 24 that blows the outdoor air toward the outdoor heat exchanger 13. Furthermore, an oil-return circuit 25 for returning the lubricant separated from the discharged refrigerant gas in the oil separator 11 to the compressor 10 side by a predetermined amount at a time is provided between the oil separator 11 and an intake pipe of the compressor 10.

The gas-side pipe 4 and the liquid-side pipe 5 are the refrigerant pipes that are connected to the gas-side actuating valve 20 and the liquid-side actuating valve 21 of the outdoor unit 2, and the pipe length thereof is set at the time of on-site installation in accordance with the distance between the outdoor unit 2 and the plurality of the indoor units 3A and 3B to be connected thereto. An appropriate number of the splitters 6 are provided at intermediate positions in the gas-side pipe 4 and the liquid-side pipe 5, and an appropriate number of the indoor units 3A and 3B are connected via the splitters 6. Accordingly, the refrigerating cycle (refrigerant circuit) 7 is formed as a single closed system.

The indoor units 3A and 3B are provided with indoor heat exchangers 30 in which the indoor air undergoes heat exchange with the refrigerant to be supplied for air conditioning of room interiors, a cooling expansion valves (EEVC) 31, indoor fans 32 that circulate the indoor air via the indoor heat exchangers 30, and indoor controllers 33, and the indoor units 3A and 3B are connected to the splitters 6 via gas-side splitting pipes 4A and 4B and liquid-side splitting pipes 5A and 5B on the indoor side.

The cooling operation of the multi-type air conditioner 1 described above is performed as follows.

In the oil separator 11, the lubricant contained in the refrigerant is separated from high-temperature, high-pressure refrigerant gas compressed and discharged from the compressor 10. Subsequently, the refrigerant gas is circulated by the four-way switching valve 12 to the outdoor heat exchanger 13 side and is condensed into liquid through heat exchange at the outdoor heat exchanger 13 with the outdoor air blown thereon by the outdoor fan 24. This liquid refrigerant is further cooled by the supercooling coil 14, subsequently passes through the heating expansion valve 15, and is temporarily stored in the receiver 16.

The liquid refrigerant, whose circulated amount is adjusted at the receiver 16, is diverted from the liquid refrigerant pipe in the process of flowing at the liquid refrigerant pipe side via the supercooling heat exchanger 17, and the liquid refrigerant undergoes heat exchange with adiabatically expanded refrigerant at the supercooling expansion valve (EEVSC) 18 to be supercooled. This liquid refrigerant is guided to the liquid-side pipe 5 from the outdoor unit 2 via the liquid-side actuating valve 21, and, furthermore, the liquid refrigerant that has been guided to the liquid-side pipe 5 is diverted to the liquid-side splitting pipes 5A and 5B of the individual indoor units 3A and 3B via the splitters 6.

The liquid refrigerant diverted to the liquid-side splitting pipes 5A and 5B flows into the individual indoor units 3A and 3B, is adiabatically expanded at the cooling expansion valves (EEVC) 31, and flows into the indoor heat exchangers 30 as gas-liquid two-phase flows. At the indoor heat exchangers 30, heat exchange occurs between the indoor air circulated by the indoor fans 32 and the refrigerant, thus cooling the indoor air to be supplied for cooling the room interiors. On the other hand, the refrigerant is gasified, reaches the splitters 6 via gas-side splitting pipes 4A and 4B, and is combined with the refrigerant gas from other indoor units at the gas-side pipe 4.

The refrigerant gas combined at the gas-side pipe 4 returns to the outdoor unit 2 again, combines with the refrigerant gas from the supercooling heat exchanger 17 via the gas-side actuating valve 20 and the four-way switching valve 12, and is subsequently introduced to the accumulator 19. At the accumulator 19, the liquid component contained in the refrigerant gas is separated and only the gas component is taken into the compressor 10. This refrigerant is compressed again in the compressor 10, and the cooling operation is performed by repeating the above-described cycle.

On the other hand, the heating operation is performed as follows.

The high-temperature, high-pressure refrigerant gas that has been compressed by the compressor 10 and then discharged therefrom is circulated to the gas-side actuating valve 20 side via the four-way switching valve 12 after the lubricant contained in the refrigerant is separated at the oil separator 11. The refrigerant is guided out from the outdoor unit 2 via the gas-side actuating valve 20 and the gas-side pipe 4, and, furthermore, it is introduced to the plurality of the indoor units 3A and 3B via the splitters 6 and the gas-side splitting pipes 4A and 4B on the indoor side.

The high-temperature, high-pressure refrigerant gas that has been introduced to the indoor units 3A and 3B undergoes heat exchange at the indoor heat exchangers 30 with the indoor air circulated by the indoor fans 32, and thus, the indoor air is heated to be supplied for heating of the room interiors. The liquid refrigerant that has been condensed at the indoor heat exchangers 30 reaches the splitters 6 via the cooling expansion valves (EEVC) 31 and the liquid-side splitting pipes 5A and 5B and is returned to the outdoor unit 2 via the liquid-side pipe 5 after being combined with the refrigerant from the other indoor units. Note that, in the indoor units 3A and 3B during heating, the degree of opening of the cooling expansion valves (EEVC) 31 is controlled by the indoor controllers 33 so that the refrigerant outlet temperature (hereinafter, referred to as heat-exchange outlet temperature) or refrigerant supercooling at the indoor heat exchangers 30, which function as condensers, reach control target values.

The refrigerant that has returned to the outdoor unit 2 reaches the supercooling heat exchanger 17 via the liquid-side actuating valve 21 and, after being supercooled, as in the case of cooling, flows into the receiver 16 so that the circulated amount of the refrigerant is adjusted by temporarily being stored therein. This liquid refrigerant is supplied to the heating expansion valve (EEVH) 15 to be adiabatically expanded and subsequently flows into the outdoor heat exchanger 13 via the supercooling coil 14.

At the outdoor heat exchanger 13, heat exchange is performed between the refrigerant and the outdoor air that is blown thereon by the outdoor fan 24, and the refrigerant is evaporated and gasified by absorbing heat from the outdoor air. The refrigerant from the outdoor heat exchanger 13 is combined with the refrigerant gas from the supercooling heat exchanger 17 via the four-way switching valve 12 and is then introduced to the accumulator 19. The liquid component contained in the refrigerant gas is separated at the accumulator 19 and only the gas component is taken into the compressor 10 to be compressed again at the compressor 10. The heating operation is performed by repeating the above-described cycle.

In the multi-type air conditioner 1 applied to air conditioning in a building, etc., the length of the refrigerant pipes between the outdoor unit 2 and the indoor units 3A and 3B becomes very long. Because of this, the lubricant that has flowed out along with the refrigerant from the compressor 10 to the refrigerating cycle (refrigerant circuit) 7 side tends to remain in the refrigerating cycle (refrigerant circuit) 7, and a situation tends to occur in which the amount of lubricant at the compressor 10 side becomes insufficient. Therefore, in order to recover the lubricant that has flowed out from the compressor 10 to the refrigerating cycle (refrigerant circuit) 7 back into the compressor 10, the oil-return operation is performed when predetermined oil-return conditions are satisfied by continuing the operation of the air conditioner 1.

When the oil-return conditions are satisfied, the oil-return-operation control portion 40 sets the refrigerating cycle (refrigerant circuit) 7 to the cooling cycle described above via the four-way switch valve 12, during which the rotational speed of the compressor 10 is increased to a set rotational speed, and the degree of opening of the cooling expansion valves (EEVC) 31 of all indoor units 3A and 3B is increased to a set degree of opening via the indoor controllers 33, thereby executing this oil-return operation.

In this case, the oil-return conditions are one or both of (A) when the continuous operation time of the air conditioner 1 or cumulative operation time thereof reaches a predetermined amount of time and (B) when a calculated amount of lubricant that has flowed out from the compressor 10 reaches a predetermined amount; and when operating-time accumulating means 41 or outflowed-lubricant-amount calculating means 42 detects that the conditions (A),(B) are satisfied, the oil-return operation is performed via the oil-return-operation control portion 40.

The oil-return conditions (A) and (B) have been known in the related art. In this embodiment, in addition to these conditions (A) and (B), the outdoor air temperature is monitored, and continuation of a state in which the outdoor air temperature detected by an outdoor air temperature sensor 44 is higher than a set value (for example, 49° C.) over a predetermined time (for example, 3 minutes) is added as a condition (C), and high-outdoor-air-temperature oil-return operation means 43 is provided, which performs a forced oil-return operation via the oil-return-operation control portion 40 when this condition (C) is satisfied. In addition, after performing the forced oil-return operation via this high-outdoor-air-temperature oil-return operation means 43, the oil-return operation is prohibited for a certain period of time (for example, three hours).

While the oil-return operation is prohibited for the certain period of time, the oil-return operation is prohibited even if the state in which the outdoor air temperature is high continues and the outdoor air temperature equal to or above the set value is re-detected, or even if the above-described oil-return conditions (A),(B) are satisfied. On the other hand, in the case in which the outdoor air temperature is below the set value described above, the prohibition of the oil-return operation for the certain period of time is removed, and the oil-return operation is performed when the above-described conditions (A),(B) are satisfied.

Furthermore, in this embodiment, when the oil-return operation is performed because the above-described three conditions (A), (B), and (C) are satisfied, the degree of opening of the cooling expansion valves (EEVC) 31 is increased to the set degree of opening by the indoor controllers 33 and the rotational speed of the compressor 10 is increased to the set rotational speed; and, in addition, this embodiment is provided with high-pressure-protection-value changing means 46 that is activated on the basis of detection values of a high-pressure sensor 45 and that increases a high-pressure-protection value of a high-pressure pressure switch (not shown) for high-pressure protection that causes abnormal halt of the compressor 10 by a predetermined value (for example, 3.7 MPa is changed to 3.8 MPa).

FIG. 2 shows a control flow diagram of the oil-return operation described above. For the oil-return operation as shown in FIG. 2, the oil-return operation is performed when the operating-time accumulating means 41, the outflowed-lubricant-amount calculating means 42, and the high-outdoor-air-temperature oil-return operation means 43 detect, during normal cooling/heating operation of the air conditioner 1, that any of the following three conditions is satisfied, (A) when the continuous operation time or cumulative operation time has reached the predetermined amount of time, (B) when the amount of outflowed lubricant (oil rise level) has reached the predetermined amount, and (C) when the state in which the outdoor air temperature is higher than the set value continues for the predetermined period of time.

Then, in this oil-return operation, in addition to setting the refrigerating cycle (refrigerant cycle) 7 to the cooling cycle, the following three actions are simultaneously performed, (1) the high-pressure-protection value is increased by the predetermined value, (2) the degree of opening of the cooling expansion valves 31 off all of the indoor units 3A and 3B is increased to the set degree of opening, and (3) the rotational speed (drive frequency) of the compressor 10 is increased to the set rotational speed.

Note that the oil-return operation is terminated when known operation-terminating conditions set in advance are satisfied. In addition, at the time of terminating the oil-return operation, "success" or "failure" of the oil-return operation is determined (for example, the case in which intake superheating SH of the compressor 10 continues to be at or below a predetermined value over a predetermined period of time is determined to be success), and in the case of "failure", a retry-oil-return operation is performed under the predetermined conditions.

With the above-described configuration, this embodiment affords the following effects and advantages.

When the operating-time accumulating means 41, the outflowed-lubricant-amount calculating means 42, and the high-outdoor-air-temperature oil-return operation means 43 detect, during normal cooling/heating operation of the air conditioner 1, that any one of the above-described oil-return conditions (A), (B), and (C) is satisfied, the oil-return-operation control portion 40 sets the refrigerating cycle (refrigerant circuit) 7 to the cooling cycle, increases the high-pressure-protection value of the high-pressure pressure switch, which is activated on the basis of the detection value from the high-pressure sensor 45, by the predetermined value, increases the degree of opening of the cooling expansion valves (EEVC) 31 of the indoor units 3A and 3B to the set degree of opening via the indoor controllers 33, and, furthermore, increases the rotational speed (drive frequency) of the compressor 10 to the set rotational speed, thus starting the oil-return operation.

With this oil-return operation, the circulated amount of the refrigerant in the refrigerating cycle (refrigerant circuit) 7 is increased, and the flow speed thereof is also increased; therefore, the lubricant that has flowed out from the compressor 10 to the refrigerating cycle 7 side and that remains in the indoor heat exchangers 30, the refrigerant pipes 4, 4A, 4B, 5, 5A, and 5B, etc. is recovered back into the compressor 10 together with the flow of the refrigerant. Then, when the terminating conditions set in advance are satisfied, the oil-return operation is terminated, and the original cooling/heating operation is restored.

In this way, in this embodiment, the oil-return operation is also performed when a state in which the outdoor air temperature is higher than the set value continues for the predetermined period of time, in addition to when the continuous operation time of the air conditioner 1 or the cumulative operation time thereof reaches the predetermined amount of time and the amount of outflowed lubricant (oil rise level) from the compressor 10 reaches the predetermined amount, and the oil-return operation is prohibited for the predetermined period of time after performing this forced oil-returning operation via the high-outdoor-air-temperature oil-return operation means 43. Accordingly, when the state in which the outdoor air temperature is higher than the set value has continued for the predetermined time, the forced oil-return operation can be performed in advance before the temperature increases further and the oil-return operation becomes difficult due to high-pressure shutdown, and, by doing so, in the certain period of time that follows, the operation of the air conditioner 1 can be continued without having to perform the oil-return operation.

Therefore, it is possible to reliably avoid a situation in which the operation is continued for a long period of time without commencing the oil-return operation due to an abnormally high temperature and in which the amount of lubricant in the compressor 10 decreases such that the lubricant in the compressor 10 runs out, causing damage; and thus, the reliability of the air conditioner 1 can be increased.

In addition, during the certain period of time in which the oil-return operation is prohibited, as described above, the forced oil-return operation due to re-detection of the outdoor air temperature at or above the set value and the oil-return operation due to detection of the above-described oil-return conditions (A), (B) are prohibited. In this way, by prohibiting the oil-return operation due to detection of the above-described oil-return conditions (A) to (C) for the certain period of time after performing the forced oil-return operation via the high-outdoor-air-temperature oil-return operation means 43, it is possible to prevent unnecessarily repeating the oil-return operation. Therefore, interruption of normal cooling/heating operation caused by performing the oil-return operation can be minimized, and the comfort level can be maintained.

Furthermore, because the prohibition of the oil-return operation for the certain period of time is removed when the outdoor air temperature is below the set value, when the prohibition of the oil-return operation for the certain period of time is removed because the outdoor air temperature is below the set value, the normal oil-return operation is restored, and thus, the oil-return operation is performed when the predetermined oil-return conditions (A) to (C) are satisfied. Therefore, it is possible to cope with an environment in which the outdoor air temperature is high while maintaining the oil-return-operation function based on the conventional oil-return conditions (A) and (B), and it is possible to expand the regions where the air conditioner 1 can be installed.

In addition, in this embodiment, when performing the oil-return operation, the high-pressure-protection value of the high-pressure pressure switch is increased by the predetermined value via the high-pressure-protection-value changing means 46. Accordingly, when the oil-return operation is performed by increasing the rotational speed of the compressor 10, although the high pressure easily increases, the high-pressure pressure switch is activated, and thus the compressor 10 may come to an abnormal halt due high-pressure shutdown, the abnormal stop of the compressor 10 due to the high-pressure shutdown can be prevented by increasing the high-pressure-protection value by the predetermined value via the high-pressure-protection-value changing means 46 and the forced oil-return operation can be performed. Therefore, the oil-return operation can be performed reliably even if the air conditioner 1 is installed in an environment in which the outdoor air temperature is high, and the reliability of the air conditioner 1 can be increased by avoiding a situation in which the lubricant in the compressor 10 runs out.

Note that the present invention is not limited to the above-described embodiment, and appropriate alterations are possible within a range that does not depart from the spirit thereof. For example, in the above-described embodiment, the high-pressure-protection value of the high-pressure pressure switch is increased by the predetermined value via the high-pressure-protection-value changing means 46 regardless of the oil-return conditions (A) to (C) under which the oil-return operation is performed; however, the oil-return operation may be performed by changing the high-pressure-protection value of the high-pressure pressure switch only when performing the forced oil-return operation via the high-outdoor-air-temperature oil-return operation means 43, during which the high pressure increases particularly easily.

REFERENCE SIGNS LIST

1 air conditioner
2 outdoor unit
3A, 3B indoor unit
7 refrigerating cycle (refrigerant circuit)
10 compressor
31 cooling expansion valve (EEVC)
40 oil-return-operation control portion
41 operation-time accumulating means
42 outflowed-lubricant-amount calculating means
43 high-outdoor-air-temperature oil-return operation means
44 outdoor air temperature sensor
45 high pressure sensor
46 high-pressure-protection-value changing means

The invention claimed is:

1. An air conditioner which is provided with an oil-return-operation control portion that performs an oil-return operation, when oil-return conditions are satisfied, by controlling a compressor rotational speed and a degree of opening of an expansion valve with a predetermined refrigerant cycle, the air conditioner comprising:

an outdoor air temperature sensor; and high-outdoor-air-temperature oil-return operation means for performing a forced oil-return operation via the oil-return-operation control portion when an outdoor temperature increases and a state in which a detection value from the outdoor air temperature sensor is higher than a set value continues for a predetermined period of time, wherein the oil-return operation is prohibited for a certain period of time after performing the forced oil-return operation via the high-outdoor-air-temperature oil-return operation means.

2. An air conditioner according to claim 1, wherein the forced oil-return operation due to re-detection of the outdoor air temperature at or above the set value and the oil-return operation due to detection of oil-return conditions are prohibited during the certain period of time in which the oil-return operation is prohibited.

3. An air conditioner according to claim 1, wherein the prohibition of the oil-return operation for the certain period of time is removed when the outdoor air temperature is below the set value.

4. An air conditioner according to claim 1, further comprising high-pressure-protection-value changing means for increasing a high-pressure-protection value, at which the compressor is halted in association with an increase in refrigerant pressure by a predetermined value, at least when performing the forced oil-returning operation via the high-outdoor-air-temperature oil-return operation means.

* * * * *